United States Patent [19]

Bell, Jr. et al.

[11] Patent Number: 4,658,564

[45] Date of Patent: Apr. 21, 1987

[54] COUPON INSERTER FOR CARTONS

[75] Inventors: Cecil R. Bell, Jr., Pinnacle; Richard Thomas, Winston-Salem; Jasper R. London, Winston-Salem; Walter R. Sizemore, Winston-Salem, all of N.C.

[73] Assignee: Sara Lee Corporation, Winston-Salem, N.C.

[21] Appl. No.: 815,560

[22] Filed: Jan. 2, 1986

[51] Int. Cl.[4] ..... B65B 61/20; B65B 39/12

[52] U.S. Cl. ..... 53/250; 53/50; 53/258; 221/211; 271/101; 271/102; 271/103

[58] Field of Search ..... 53/244, 258, 260, 250, 53/249, 50; 221/211; 271/99, 101, 102, 103; 294/64

[56] References Cited

U.S. PATENT DOCUMENTS

| | | | |
|---|---|---|---|
| 1,395,232 | 10/1921 | Kronquest | 271/102 |
| 1,908,094 | 5/1933 | Williams . | |
| 1,953,761 | 4/1934 | Krug et al. | 271/32 |
| 2,294,273 | 8/1942 | Buxbaum | 271/5 |
| 2,341,521 | 2/1944 | Baker et al. | 271/103 |
| 2,734,674 | 2/1956 | Ray | 221/211 X |
| 3,108,714 | 10/1963 | O'Brien | 221/211 |
| 3,390,875 | 7/1968 | Beert et al. | 271/5 |
| 3,432,984 | 3/1969 | Bivans | 53/120 |
| 3,523,400 | 8/1970 | Daily | 53/117 |
| 3,702,698 | 11/1972 | Schwebel | 271/103 |
| 3,797,822 | 3/1974 | Anderson | 271/12 |
| 3,887,177 | 6/1975 | Farfaglia et al. | 271/12 |
| 3,937,458 | 2/1976 | Langen | 271/95 |
| 4,081,945 | 4/1978 | Calvert et al. | 53/186 |
| 4,082,203 | 4/1978 | Schjeldahl | 221/211 |
| 4,154,438 | 5/1979 | Seragnoli | 271/102 X |
| 4,189,137 | 2/1980 | Denney et al. | 271/103 |
| 4,203,269 | 5/1980 | Peterson | 53/258 X |

*Primary Examiner*—Horace M. Culver

*Attorney, Agent, or Firm*—Charles Y. Lackey; William S. Burden

[57] ABSTRACT

A device for placing articles such as coupons or the like in cartons being conveyed past a work station containing the device. The device includes an upright coupon or the like article supply hopper, a reciprocatory mechanism for inserting the articles into the cartons as they are conveyed past and momentarily stopped adjacent thereto and a reciprocating vacuum or suction mechanism for removing the coupons from the supply hopper and placing them in the path of the inserting mechanism for placement into cartons.

13 Claims, 4 Drawing Figures

COUPON INSERTER FOR CARTONS

FIELD OF THE INVENTION

This invention relates to the art of packaging or placing coupons or the like in cartons and, more particularly, to a mechanism for rapidly transferring coupons from a supply to an inserting station in a rapid and repetitive manner.

BACKGROUND OF THE INVENTION

There are several well-known devices for transferring coupons, leaflets, etc. from a supply to an insertion station for insertion into cartons. For example, U.S. Pat. No. 3,523,400 to Daily shows a very complicated device which moves with the carton as it inserts a coupon or the like therein. In the patent to Anderson, U.S. Pat. No. 3,797,822, the transfer mechanism includes an eccentric crank, rack and pinion type device which is seriously subjected to wear, thus requiring frequent repair. The Bivans U.S. Pat. No. 3,432,984 and Beer et al. U.S. Pat. No. 3,390,875 show inserts that are extremely complicated and expensive to manufacture.

SUMMARY OF THE INVENTION

In accordance with the principles of the present invention, a preferred embodiment of an insertion device is adapted to successively extract a coupon or the like, each successive lowermost one of the stack of coupons with a fluid actuated reciprocating motor having a vacuum cup attached thereto and moving the same to a position in which a system of second and third fluid reciprocating motors inserts the coupon into the carton.

For a better understanding of the invention, reference may be had to the following detailed description taken in conjunction with the accompanying drawings in which.

Figure 1:
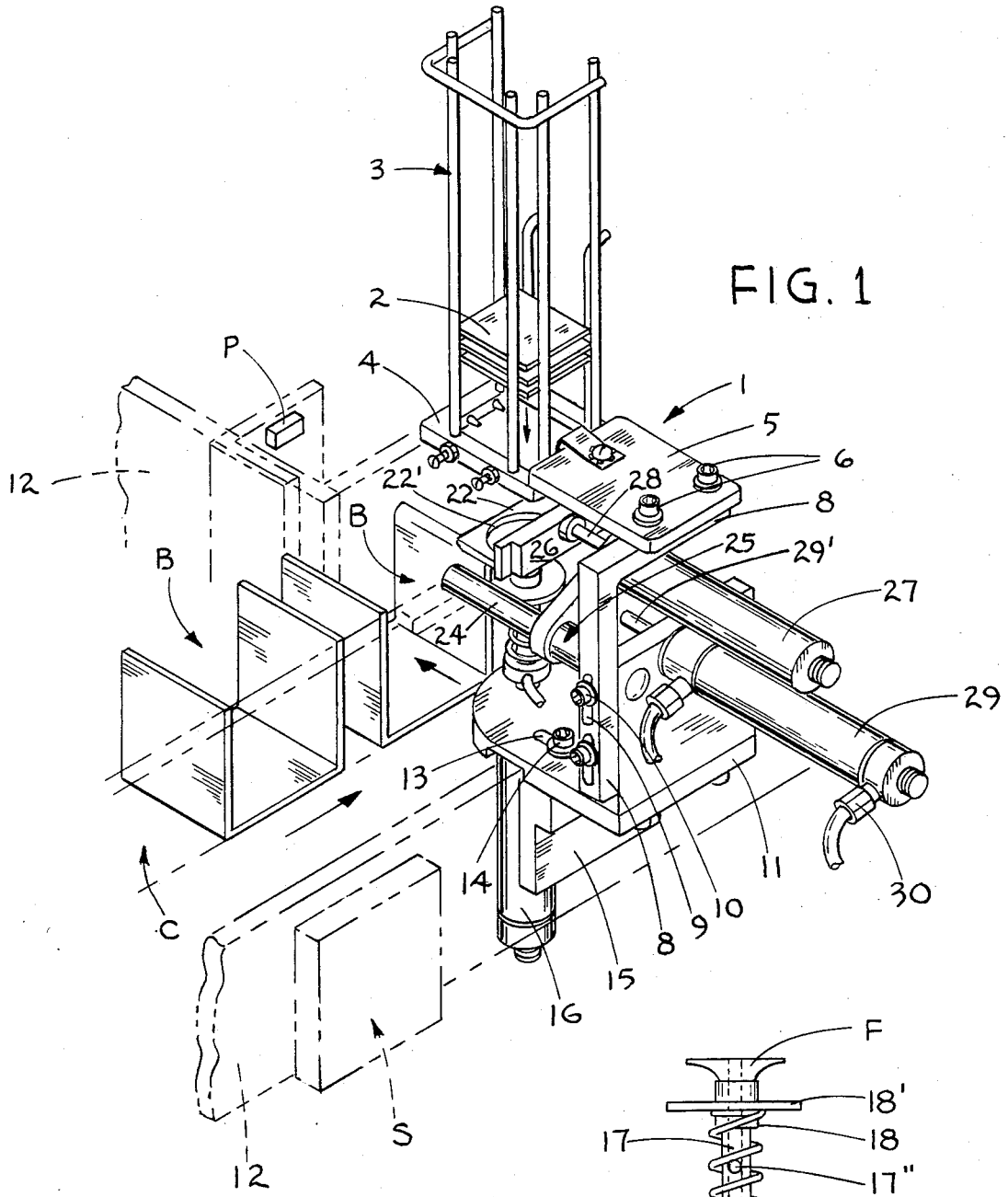
FIG. 1 is a perspective view of the inserter and its relationship with a conveyor and its frame with parts thereof in broken lines.
Figure 4:
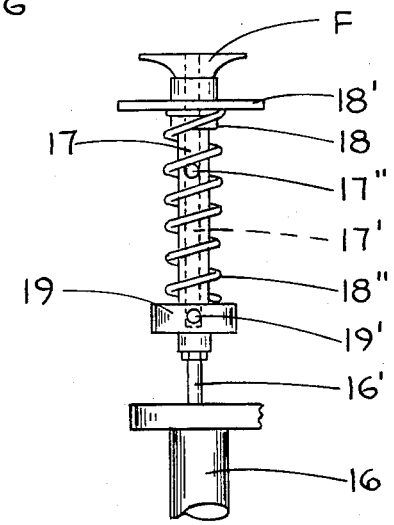
FIG. 4 is a diagrammatic view in elevation of the extraction plunger.

As shown in the drawings for purposes of illustration, the invention is embodied in an apparatus 1 for removing articles such as coupons 2 one by one from a stack supported in a conventional manner in a magazine or hopper 3 and delivering the coupons to and inserting them into receptacles, cartons, etc., A, supported in receiving compartments B on conveyor C as the conveyor moves the receptacles past an article insertion station.

Figure 2:
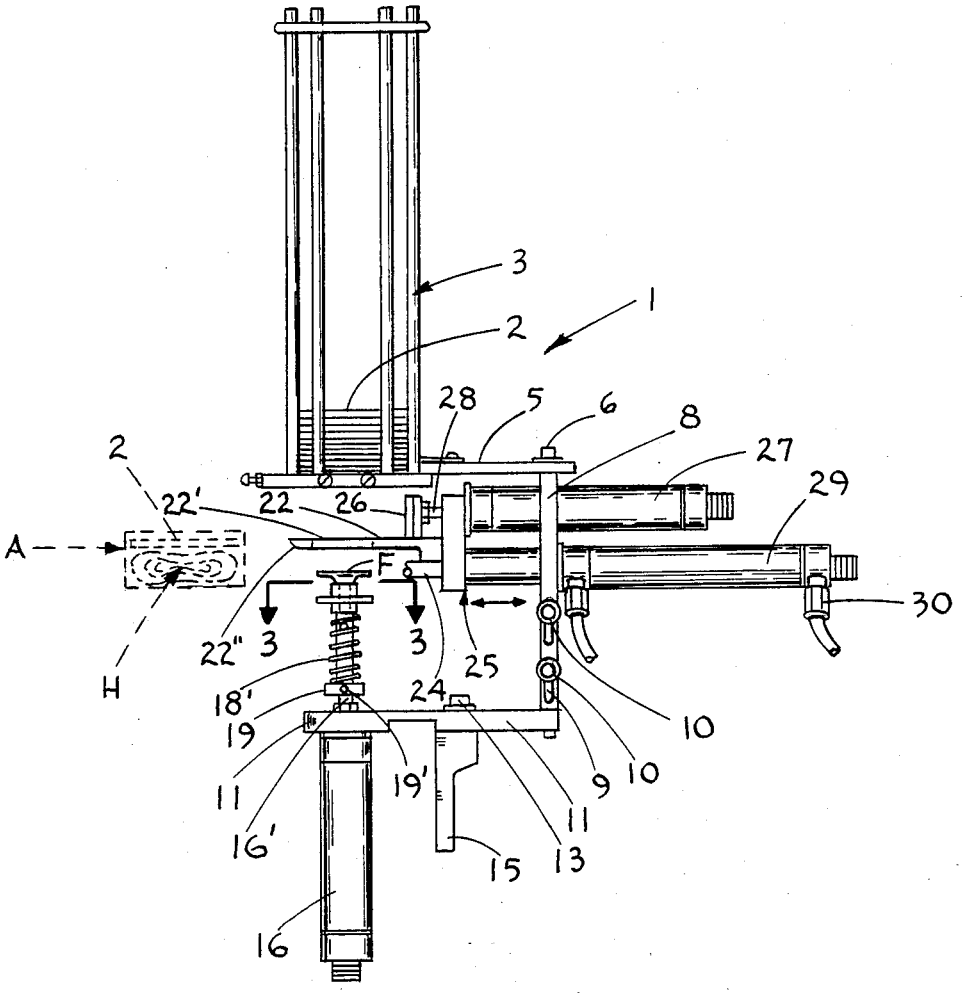
FIG. 2 is a diagrammatic view in elevation of the side of the inserter separated from the conveyor and support for clarity.
Figure 3:
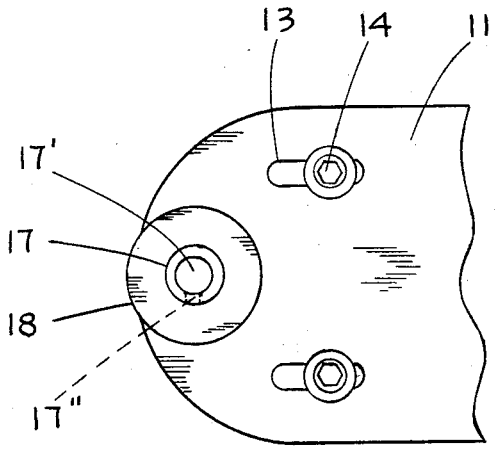
FIG. 3 is a top elevational view of the vacuum plunger and support taken along lines 3—3 of FIG. 2.

As shown in FIG. 1, the article insertion assembly 1 is fixed to conveyor frame 12 and faces the conveyor C having receptacles A supported thereon within compartments B. The assembly 1 includes the hopper 3 having a base 4 welded or otherwise attached to support plate 5. The plate support 5 is fixed by fasteners 6 to a support 8. The support 8 is vertically adjustably mounted on a main L-shaped support or bracket 11 by means of fasteners 10 and slots 9. In turn, the bracket 11 is attached to the conveyor or machine frame 12 by a suitable member 15 which is adjustable relative to bracket 11 by means of slots 13 and fasteners 14. Base 4 is releasably attached to both frame 12 and support 8 for purposes of stability. Thus, the hopper 3 can be replaced with others of various sizes and shapes for receiving like shapes and sizes of articles. The several elements that make up the mechanism for extracting the articles from the hopper and placing same in the carton, box or the like are attached to the L-shaped support 11. As shown in FIGS. 1 and 2, attached to the horizontal leg of the L-shaped bracket is the mechanism for extracting the articles 2 from the hopper and moving them to the position from which they are inserted into the cartons, which mechanism includes a double-acting fluid motor 16 of conventional design attached to the lower surface of said horizontal leg with its piston 16' extending through and vertically above said leg in alignment with the hopper 3. An important novel feature of the present invention resides in the arrangement of a vacuum applicator and breaker defined by the exposed upper or remote end 17 of the piston rod 16', which arrangement includes a lower sleeve or keeper 19 fixed to a lower section of rod end 17, an upper freely slidable sleeve 18 having a washer-like shoulder 18' extending therearound on an upper section of end 17, compression spring means 18'' extending between said sleeves and surrounding a portion of rod end 17, and vertically spaced upper and lower apertures 17'' and 19' in said end communicating with a bore 17' extending substantially through the length of section 17 of rod 16'. While lower aperture 19' to which a vacuum line is to be attached is illustrated as being in the spring anchor member 19, the same could be located along rod end 17 displaced from said anchor 19. A suction cup F is secured to the upper portion of section 17 coaxial with slidable sleeve 18.

Reference is now made to the article or coupon inserting mechanism which is attached to the vertically extending leg of the L-shaped main support 11. As shown in FIGS. 1 and 2, double-acting fluid motor 29 is fixed to support 11 with its rod 29' freely extending therethrough. Attached to the end of piston rod 29' is a yoke 25 which is guided by and freely slidable on laterally spaced guide rods 24, FIG. 1, only one of which has been shown, which are fixed to the vertical leg of the main support 11. Affixed to yoke 25 is a double-acting fluid motor 27 with its piston rod 28 extending freely therethrough, to the end of which is attached an elongated coupon or the like engaging plate 26. As shown in FIG. 1, piston 27 is permitted to move with yoke 25 since it is located in the space between hopper support 8 and main support 11. Also, attached to yoke 25 and movable therewith is an apertured plate-like platform, shelf or the like 22 for receiving articles 2 extracted from hopper or magazine 3 and which slidably supports plate 26 attached to piston rod 28. Plate 22 has an opening 22' therein which is in alignment with rod 17.

Broadly illustrated in FIG. 1 on the opposite side of conveyor C from the inserter assembly is a photocell P which initiates the operation of the invention. It should be noted that the photocell type control means is for purposes of illustration only and many other sensing type mechanisms could be employed. Also, a control means S coupled to the photocell, the various fluid cylinders and the conveyor drive for controlling the sequence of operation of the various components is common in the art and forms no part of the novel features of the invention apart from the clear understanding of the disclosure. The control means is schematically illustrated on FIG. 1.

In operation, as conveyor C moves a compartment B with a carton A therein in which a coupon or the like is to be placed to the insertion station, the presence thereof is sensed by photocell P or the like which, through the control means S, causes the conveyor to pause and at the same instant actuates fluid motor 16 extending rod 16' and rod end 17 vertically. Simultaneously through the control means S, vacuum is applied to lower aperture 19' which will draw vacuum through the central portion of bore 17 and upper opening 17'', and as end 17 continues to move upwardly, sleeve shoulder 18' will engage the bottom of plate 22, and as end 17 continues to move upwardly through the aperture 22' of plate 22, the aperture 17'' will be covered by sleeve 18 and the vacuum or suction will be redirected throughout the length of bore 17'. Continued movement of rod end 17 extends the suction cup F to a position where it engages and grasps the lowermost of the coupons 2 in the hopper 3. At this instant the fluid in cylinder 16 is reversed through the control means S, thereby retracting rod end 17 with the coupon 2 held thereon by vacuum downwardly until the coupon engages the top surface of the apertured platform or plate 22. At this point, rod end 17 has moved downwardly enough that compressions spring 18'' engaging and biasing sleeve 18 upwardly has caused aperture 17'' to again be exposed; e.g., moved from under sleeve 18, thereby breaking the vacuum between the upper end of the rod 17 and coupon 2 leaving the same resting on the top surface of apertured platform 22 in position to be moved to and inserted into a carton or the like. At this time, through control means S, the fluid motor 29 is actuated moving rod 29', yoke 25, fluid motor 27, its rod 28, plate 26 and platform 22 to the left to the broken line position with platform 22 and coupon 2 thereon within a carton A. With platform 22 and the coupon now inside the carton, fluid motor 29 is reversed thereby to retract the platform 22, yoke 25 and fluid motor 27. As platform 22, yoke 25 and motor 27 are being retracted, fluid in motor 27 extends rod 28 and plate 26 so that the coupon will not retract with the platform 22 and remain in the carton. In other words, plate 26 remains stationary at the mouth or opening of the carton due to the movement of yoke 25 and cylinder 27 in one direction while at the same time the rod 28 extends from the cylinder 27 until platform 22 has retracted. As soon as yoke 25 and platform 22 have retracted, fluid is reversed in cylinder 27, thereby retracting plate 26. Note that free end 22'' of plate 22 is smoothly tapered downwardly and back toward the right as viewed in FIG. 2. In some instances, there will be a product, such as hosiery, in the carton and the taper 22'' on plate 22 will, as it enters the carton, in effect press downwardly on such product rather than tend to push it out of the opposite end of the carton. Note further than when the coupon is being placed in the carton, the right-hand edge thereof is engaged by plate 26 as it is resting on platform 22 and the movement of platform 22 inserts the coupon into the carton, and as the platform retracts plate 26 prevents the coupon from remaining with the platform. The mechanism is now ready for a subsequent operation.

While the invention has been explained with the coupon extraction and positioning feature being the initial operation, it could be the final operation of a complete cycle; e.g., the sensing mechanism could trigger the insertion mechanism to insert a coupon which had been deposited or positioned in position by the last step of the previous cycle.

Various steps of sensing mechanisms, control mechanisms for the various fluid motors and vacuum control means presently available in the marketplace may be provided for correlating the various movement of the elements of the coupon insertion mechanism. Essentially, it is the physical shape, location and continuous sequential motions of the various elements for extracting the coupons from the magazine or hopper and positioning them in position for the insertion device to move them into the carton or the like which constitute the essential features of this invention which enable efficient and rapid operation.

While the coupons or the like are relatively thin and somewhat flimsy, it is clear that articles of some thickness and firmness could be handled by the mechanism without requiring critical alteration thereof.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be restored to falling within the scope of the claims of the invention.

What is claimed is:

1. In an article cartoner form conveying in a generally linear path a stream of open-ended cartons and having a mechanism for inserting an article, such as a coupon or the like, into an open end of each of said cartons comprising (A) a hopper for supporting a supply of articles;

(B) an elongated, vertically extending reciprocating article extractor mechanism for extracting said articles one at a time from said hopper and positioning same adjacent said conveyor and carton thereon; said mechanism comprising an elongated, vertically extending rod-like member having upper and lower ends, the upper end including article grasping means, reciprocating means on said lower end adapted to extend said member to move said grasping means in engagement with said article and for retracting same to a position adjacent said carton, said grasping means also including means to release said articles at said position;

(C) an article insertion mechanism adjacent said position for receiving articles removed from the hopper and inserting the articles in cartons, said article insertion mechanism including an article support means, means for reciprocating said article support means in a horizontal direction, and means displaceable in a horizontal direction for controlling movement of an article on said article support means relative to said article support means.

2. The structure as defined in claim 1 wherein the article extracting mechanism includes a first double-acting fluid motor for extending and retracting said rod-like grasping means.

3. The structure as defined in claim 1 wherein said article grasping means at the upper end of said rod includes vacuum means for engaging the lower surface of said articles.

4. The structure as defined in claim 3 wherein said vacuum means defining said grasping means includes means for systematically and sequentially applying such vacuum for grasping said article and for breaking said vacuum for releasing said article.

5. The structure as defined in claim 4 wherein said last mentioned means includes a central bore extending through the longitudinal extent of said rod-like member, plural longitudinal spaced, transversely extending apertures communicating with said central bore, one of said apertures defining means for attaching a vacuum line thereto whereby vacuum applied to said one of said apertures will evacuate through the other of said apertures, and means on said rod to close said other aperture so as to redirect the vacuum through the upper end of the rod thereby to grasp said article.

6. The structure as defined in claim 5 wherein said last mentioned means includes a spring-biased slidable sleeve on said rod-like member and stop means located in the path of said sleeve engageable with said sleeve as said rod is extended to close said other aperture to direct vacuum to the end of said rod-like member and to open said aperture as said rod is retracted to break the vacuum from the upper end so as to deposit said article on said article support.

7. The structure as defined in claim 1 wherein said article support and insertion device further comprise horizontal reciprocating means attached thereto to transfer said article from said support and place same into said carton.

8. The structure as defined in claim 1 wherein said reciprocating means comprises a first double-acting fluid motor means having attached to the rod thereof a yoke member to which said article support means is attached.

9. The structure as defined in claim 8 wherein said article support means includes a plate having an aperture therein sufficiently large to receive therethrough said article grasping means, said plate having one end attached to said yoke member and a free end extending therefrom having a planar upper surface on which said article is placed by said extractor mechanism, said means for controlling movement of an article relative to said planar surface including an upright plate located on said planar surface in slidable relation therewith, remote from the free end thereof and engageable with an edge of the article thereby to insert said article into said carton by said reciprocating means.

10. The structure as defined in claim 9, said means for controlling movement of an article relative to said article support means including second double-acting fluid motor means attached to said yoke and moveable therewith with its rod freely extending therethrough having said upright plate attached to the end thereof, the arrangement being such that when said first fluid motor means is extended to move said yoke, article support plate, second fluid motor means, and said upright plate toward the carton, the article therein, and wherein when said first fluid motor means is actuated to retract said support plate, said yoke and said second fluid motor means, said second fluid motor means is actuated to maintain said upright plate in a fixed position for a predetermined time to hold the article support plate retracts to its initial article receiving position at which time said upright plate is retracted to its original position.

11. In an apparatus for inserting an article in a carton, a hopper for supporting a plurality of stacked articles, an elongated, vertically extending, reciprocable article extractor mechanism for extracting the articles one at a time from said hopper, an article insertion mechanism for receiving an article removed from said hopper and for positioning the article in a carton, said article insertion mechanism including an article support means, means for reciprocating said article support means in a horizontal direction, and means including an upright plate for controlling movement of an article on said article support means relative to said article support means, said article support means including a support plate having an aperture therein, said extractor mechanism including an upper end portion for engaging the lowermost of the stacked articles in said hopper and for conveying the article to said support plate, the aperture in said support plate being of a size to receive therethrough said upper end portion of said extractor mechanism as said extractor mechanism conveys an article from said hopper to said support plate.

12. The structure as defined in claim 11 wherein said reciprocating means includes a double-acting fluid motor having attached to the rod thereof a yoke member, said article support means being secured to said yoke member.

13. The structure as defined in claim 12, said means for controlling movement of an article on said article support means including double-acting fluid motor means secured to said yoke and moveable therewith and with its rod freely extending through said yoke for movement relative thereto and an upright plate secured to said rod.

* * * * *